US009190756B2

(12) United States Patent
Glick et al.

(10) Patent No.: US 9,190,756 B2
(45) Date of Patent: Nov. 17, 2015

(54) ELECTRICAL TERMINAL ASSEMBLY

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 14 days.

(21) Appl. No.: 14/331,513

(22) Filed: Jul. 15, 2014

(65) Prior Publication Data

US 2015/0038000 A1 Feb. 5, 2015

Related U.S. Application Data

(60) Provisional application No. 61/860,973, filed on Aug. 1, 2013.

(51) Int. Cl.

| | |
|---|---|
| ***H01R 13/15*** | (2006.01) |
| ***H01R 4/48*** | (2006.01) |
| ***H01R 13/18*** | (2006.01) |

(Continued)

(52) U.S. Cl.

CPC ..... *H01R 13/18* (2013.01); *H01R 13/113* (2013.01); *H01R 13/04* (2013.01)

(58) Field of Classification Search

CPC ..... H01R 13/18; H01R 13/113; H01R 13/04; H01R 4/48

USPC ..... 439/370, 856, 839, 857

See application file for complete search history.

(56) References Cited

U.S. PATENT DOCUMENTS

| | | | |
|---|---|---|---|
| 1,132,094 | A | 3/1915 | Hosford |
| 2,774,951 | A | 12/1956 | Kinkaid et al. |
| 2,921,287 | A | 1/1960 | Matthysse et al. |

(Continued)

FOREIGN PATENT DOCUMENTS

| | | | |
|---|---|---|---|
| CN | 102034656 | A | 4/2011 |
| CN | 104009312 | A | 8/2014 |

(Continued)

OTHER PUBLICATIONS

Chinese 1st Office Action, Application No. 201010203667.3 dated Nov. 27, 2013.

(Continued)

*Primary Examiner* — Javaid Nasri

(74) *Attorney, Agent, or Firm* — MacMillan, Sobanski & Todd, LLC

(57) ABSTRACT

An electrical assembly includes a base having a body including a first end and a second end. First and second opposed base beams extend from the first end of the body in a first direction. The assembly further includes a spring clamp having a clamp base and first and second opposed spring beams extending from the clamp base in the first direction and disposed over the first and second base beams biasing the first and second base beams towards one another. The spring clamp is assembled onto the base by moving the spring clamp along the first direction onto the base. A locking feature is integrally formed in the base and the spring clamp preventing the removal of the spring clamp from the base along a second direction opposite the first direction. The locking feature also prevents movement of the spring clamp relative to the base in a lateral direction normal to the first direction.

19 Claims, 5 Drawing Sheets

(51) Int. Cl.

| | |
|---|---|
| ***H01R 13/11*** | (2006.01) |
| *H01R 13/04* | (2006.01) |

(56) References Cited

U.S. PATENT DOCUMENTS

| | | | | |
|---|---|---|---|---|
| 3,550,069 | A | 12/1970 | Teagno | |
| 3,633,153 | A | 1/1972 | Ahmed et al. | |
| 3,914,009 | A | 10/1975 | Chia et al. | |
| 4,040,713 | A | 8/1977 | Könnemann | |
| 4,351,583 | A | 9/1982 | Belttary | |
| 4,540,235 | A | 9/1985 | Lolic | |
| 4,553,799 | A | 11/1985 | Deters | |
| 4,553,808 | A | 11/1985 | Weidler et al. | |
| 4,570,147 | A | 2/1986 | Ebi | |
| 4,583,812 | A | 4/1986 | Gross, Jr. et al. | |
| 4,646,052 | A | 2/1987 | Matsunaga et al. | |
| 4,672,352 | A | 6/1987 | Takano | |
| 4,751,490 | A | 6/1988 | Hatagishi | |
| 4,842,534 | A | 6/1989 | Mobley et al. | |
| 4,869,686 | A | 9/1989 | Michaels et al. | |
| 4,869,972 | A | 9/1989 | Hatagishi | |
| 4,871,990 | A | 10/1989 | Ikeda et al. | |
| 4,932,877 | A | 6/1990 | Zinn | |
| 4,941,851 | A | 7/1990 | Hsueh | |
| 4,958,426 | A | 9/1990 | Endo et al. | |
| 5,007,865 | A | 4/1991 | Jakobeit | |
| 5,035,661 | A | 7/1991 | Steinhardt et al. | |
| 5,088,940 | A | 2/1992 | Saito | |
| 5,094,636 | A | 3/1992 | Zinn et al. | |
| 5,147,230 | A | 9/1992 | Plyler et al. | |
| 5,226,842 | A | 7/1993 | Endo et al. | |
| 5,246,390 | A | 9/1993 | Egenolf | |
| 5,288,252 | A | 2/1994 | Steinhardt et al. | |
| 5,350,321 | A | 9/1994 | Takenouchi | |
| 5,386,903 | A | 2/1995 | Rothschild et al. | |
| 5,416,461 | A | 5/1995 | Totsuka et al. | |
| 5,427,552 | A | 6/1995 | Zielinski et al. | |
| 5,437,566 | A | 8/1995 | Zinn et al. | |
| 5,474,475 | A | 12/1995 | Yamaguchi | |
| 5,488,346 | A | 1/1996 | Kondo et al. | |
| 5,573,434 | A | 11/1996 | Ittah et al. | |
| 5,581,225 | A | 12/1996 | Oh et al. | |
| 5,591,051 | A | 1/1997 | Ittah | |
| 5,647,772 | A | 7/1997 | Martucci et al. | |
| 5,658,174 | A | 8/1997 | Benes et al. | |
| 5,662,487 | A | 9/1997 | Okamura et al. | |
| 5,679,034 | A | 10/1997 | Hanazaki et al. | |
| 5,716,245 | A | 2/1998 | Kameyama et al. | |
| 5,739,741 | A | 4/1998 | Hanazaki et al. | |
| 5,745,024 | A | 4/1998 | Ohta et al. | |
| 5,795,193 | A | 8/1998 | Yang | |
| 5,868,590 | A | 2/1999 | Dobbelaere | |
| 5,886,611 | A | 3/1999 | Schaller et al. | |
| 6,036,529 | A | 3/2000 | Brown et al. | |
| 6,092,280 | A | 7/2000 | Wojnarowski | |
| 6,126,495 | A | 10/2000 | Lolic et al. | |
| 6,178,106 | B1 | 1/2001 | Umemoto et al. | |
| 6,431,880 | B1 | 8/2002 | Davis et al. | |
| 6,454,601 | B1 | 9/2002 | Vaitkus et al. | |
| 6,506,060 | B2 | 1/2003 | Sumida et al. | |
| 6,558,198 | B2 | 5/2003 | Kobayashi et al. | |
| 6,648,674 | B1 | 11/2003 | Dobler | |
| 6,722,926 | B2 | 4/2004 | Chevassus-More | |
| 6,759,938 | B2 | 7/2004 | Matsumura et al. | |
| 6,824,430 | B2 | 11/2004 | Matsumura et al. | |
| 6,872,103 | B1 | 3/2005 | Flieger et al. | |
| 7,071,808 | B2 | 7/2006 | Nakamura | |
| 7,592,892 | B2 | 9/2009 | Ito et al. | |
| 7,595,715 | B2 * | 9/2009 | Pavlovic et al. | 337/198 |
| 7,612,647 | B2 | 11/2009 | Onoda et al. | |
| 7,766,706 | B2 | 8/2010 | Kawamura et al. | |
| 7,892,050 | B2 | 2/2011 | Pavlovic et al. | |
| 8,182,299 | B2 | 5/2012 | Schrader | |
| 8,366,497 | B2 * | 2/2013 | Glick et al. | 439/839 |
| 2004/0124963 | A1 | 7/2004 | Nakamura | |
| 2006/0205267 | A1 | 9/2006 | Darr et al. | |
| 2006/0223385 | A1 | 10/2006 | Pavlovic et al. | |
| 2008/0224814 | A1 | 9/2008 | Pavlovic et al. | |
| 2009/0085712 | A1 | 4/2009 | Pavlovic et al. | |
| 2010/0323563 | A1 | 12/2010 | Pavlovic et al. | |
| 2011/0076901 | A1 | 3/2011 | Glick et al. | |
| 2012/0285720 | A1 | 11/2012 | Chou | |
| 2014/0227913 | A1 | 8/2014 | Natter | |
| 2014/0227915 | A1 | 8/2014 | Glick et al. | |
| 2014/0273659 | A1 | 9/2014 | Glick et al. | |
| 2015/0038024 | A1 * | 2/2015 | Glick et al. | 439/862 |

FOREIGN PATENT DOCUMENTS

| | | | |
|---|---|---|---|
| CN | 104051884 | A | 9/2014 |
| JP | 09147731 | | 6/1997 |
| JP | 2000133114 | A | 12/2000 |
| WO | 2012/069499 | A1 | 5/2012 |

OTHER PUBLICATIONS

Chinese 2nd Office Action, Application No. 201010203667.3 dated Jul. 17, 2014.

* cited by examiner

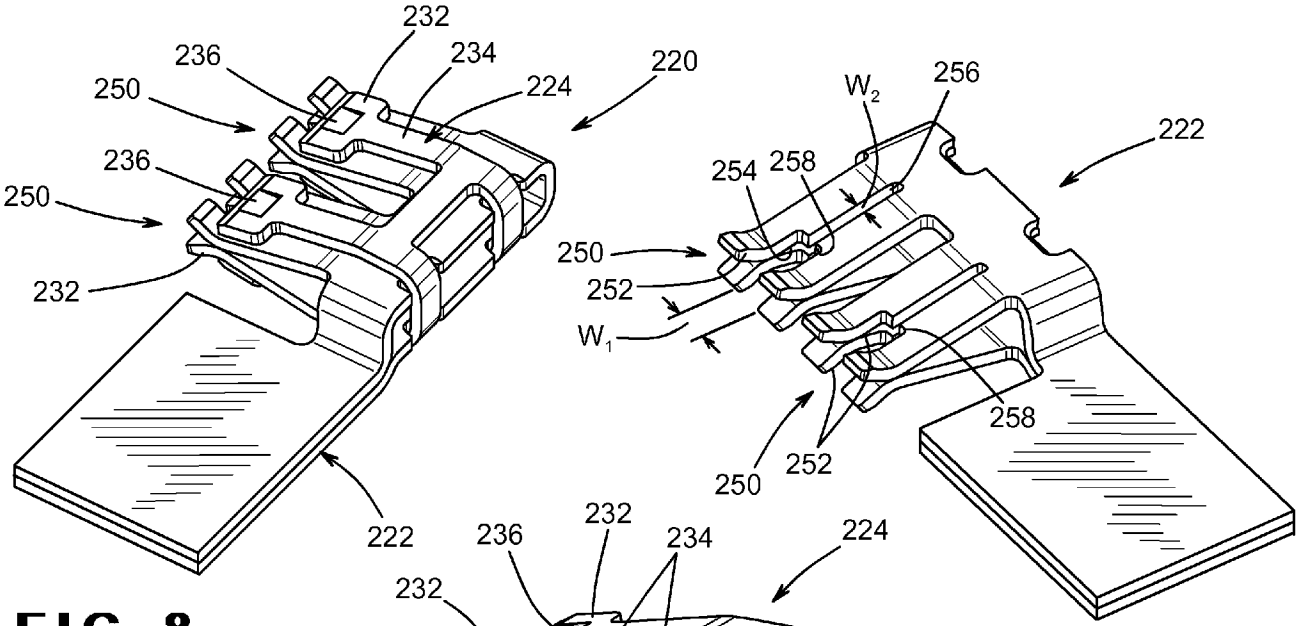
FIG. 9
FIG. 8
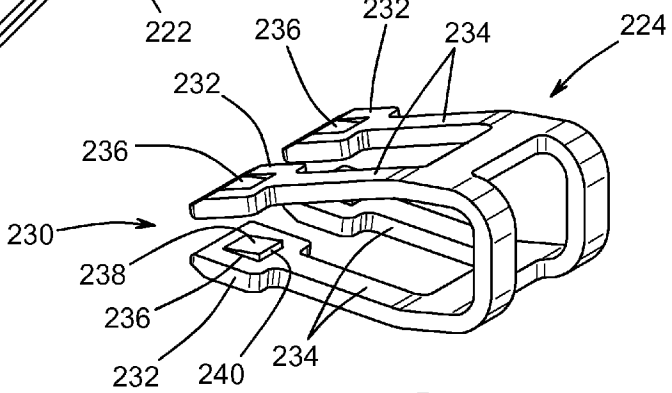
FIG. 10

ELECTRICAL TERMINAL ASSEMBLY

CROSS-REFERENCE TO RELATED APPLICATIONS

This application claims the benefit of U.S. Provisional Application No. 61/860,973, filed Aug. 1, 2013, the disclosure of which is incorporated herein by reference.

BACKGROUND OF THE INVENTION

This invention relates in general to electrical terminals such as for use in high power vehicle electrical connectors. Electrical connectors commonly include a body having a nonconductive housing encasing a conductive set of female electrical terminals. The set of female terminals are each connected to a respective end of a wire connector or fuse element retained in the housing for completing an electrical circuit. The female terminals are inserted over a set of male blade terminals. For example, the male blade terminals may be housed in another connector housing, such as for example, a power distribution box. The female terminals are typically designed with a spring-type feature to maintain a strong electrical contact with the outer surface of the male terminal blades.

Copper has good electrical conductivity properties, and has been a preferred material for terminals even though it is relatively expensive. However, copper is susceptible to relaxation (i.e., loss of spring force) as the temperature of the copper material increases. Since the temperature of the terminals increases as the current drawn in the electrical circuit increases, copper terminals have a reduced ability to maintain strong clamping force onto the male terminal blades. Relaxation of the female terminals may decrease the overall contact area with the male blades, resulting in reduced electrical conductivity, increased resistance, and a further increase in temperature.

It is desirable to keep the overall size of an electrical distribution box or other connectors as small as possible while still providing the necessary current-carrying capacity. In some situations, the spring force cannot be further increased by simply making the terminals thicker or wider. When copper is used, the size limitations may make the desired spring force unattainable.

Some conventional electrical terminals have a two-piece configuration such that a copper base is used for providing the electrical communication with a wire connector. The base includes a plurality of fingers or beams which mechanically and electrically engage with a male terminal. A spring clamp is disposed over the plurality of beams of the base such that a compressive force biases the beams in an inward direction against the male terminal. The spring clamp is made of a suitable material, such as steel, having a high yield strength or spring-like quality. The material of the spring clamp retains its spring like qualities over a relatively large temperature range, which is ideal for high power applications, such as within electric or hybrid vehicles.

SUMMARY OF THE INVENTION

This invention relates to electrical terminals and, in particular to a two-piece electrical assembly including a base having a body including a first end and a second end. First and second opposed base beams extend from the first end of the body in a first direction. The assembly further includes a spring clamp having a clamp base and first and second opposed spring beams extending from the clamp base in the first direction and disposed over the first and second base beams biasing the first and second base beams towards one another. The spring clamp is assembled onto the base by moving the spring clamp along the first direction onto the base. A locking feature is integrally formed in the base and the spring clamp preventing the removal of the spring clamp from the base along a second direction opposite the first direction. The locking feature also prevents movement of the spring clamp relative to the base in a lateral direction normal to the first direction.

According to another embodiment of an electrical terminal assembly, the assembly includes a base having a body including a first end and a second end. First and second opposed base beams extend from the first end of the body in a first direction. The second end of the body includes a notch formed therein. A spring clamp has a clamp base and first and second opposed spring beams extending from the clamp base in the first direction and disposed over the first and second base beams biasing the first and second base beams towards one another. A portion of the clamp base extends into the notch of the base preventing movement of the spring clamp relative to the base in a lateral direction normal to the first direction.

Various aspects of this invention will become apparent to those skilled in the art from the following detailed description of the preferred embodiments, when read in light of the accompanying drawings.

BRIEF DESCRIPTION OF THE DRAWINGS

FIG. 8 is a perspective view of a fourth embodiment of an electrical terminal assembly.

FIG. 9 is a perspective view of a base of the electrical terminal assembly of FIG. 8.

FIG. 10 is a perspective view of a spring clamp of the electrical terminal assembly of FIG. 8.

DETAILED DESCRIPTION OF THE PREFERRED EMBODIMENTS

Figure 1:
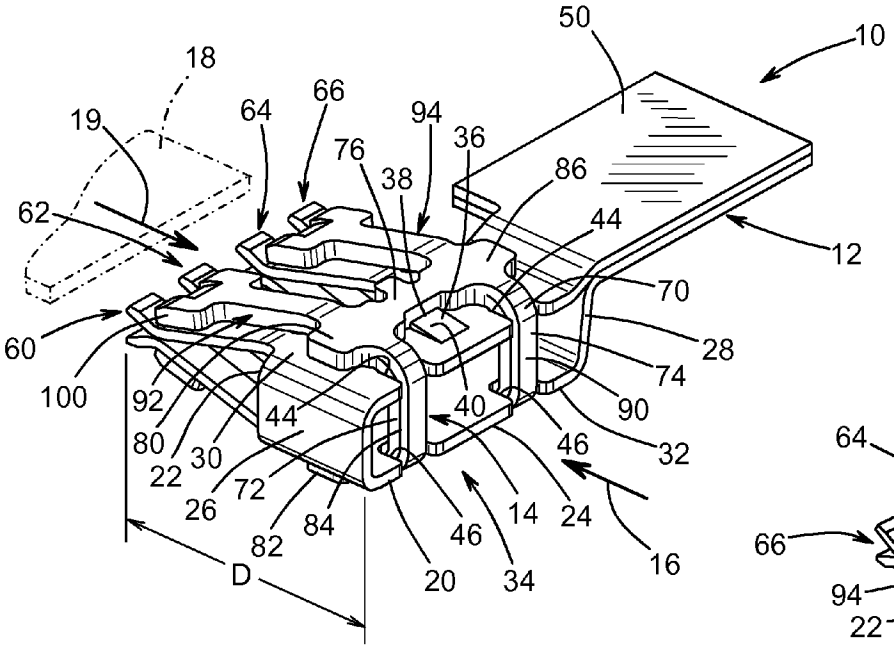
FIG. 1 is a perspective top view of a first embodiment of an electrical terminal assembly.

Referring now to the drawings, there is illustrated in FIG. 1 a first embodiment of an electrical terminal assembly, indicated generally at 10. The electrical terminal assembly 10 includes a base, indicated generally at 12, and a spring clamp, indicated generally at 14. In an assembled condition of the electrical terminal assembly 10, the spring clamp 14 is inserted over the base 12, as shown in FIG. 1. It should be understood that the base 12 and the spring clamp 14 may be shaped other than shown in the figures. As will be described below, the spring clamp 14 is assembled or mounted on the base 12 along an assembly direction 16 in a back loaded manner (from a rear end of the base) to form the electrical terminal assembly 10.

The electrical terminal assembly 10 is used to make an electrical connection with an electrical connector, such as a male terminal blade, indicated by broken lines 18, as shown in FIG. 1. The blade 18 is inserted into the electrical terminal assembly 10 along an insertion direction 19 opposite the assembly direction 16. The electrical terminal assembly 10 may be inserted, molded into, or otherwise secured to a plastic body of a connector (not shown). The connector may include multiple electrical terminal assemblies 10 mounted therein. The electrical terminal assembly 10 is well suited for use in high power distribution boxes used in automotive vehicles.

The base 12 may be formed from a single metallic blank which is stamped and formed into the configuration shown in FIGS. 1 through 5. Similarly, the spring clamp 14 may also be formed from a single metallic blank which is stamped and formed into the configuration shown in FIGS. 1 through 5. The base 12 is preferably made of an electrically conductive material such as a copper alloy or an aluminum alloy. As will be explained below, the spring clamp 14 generally is provided to assist in forcing or pushing electrical contact engagement surfaces of the base 12 against the blade 18. Therefore, the spring clamp 14 is preferably made of a material, such as stainless steel, having a relatively high yield strength or spring-like quality. Preferably, the material of the spring clamp 14 can retain its spring like qualities over a relatively large temperature range, which can act on the electrical terminal assembly 10 in high power applications, such as within electric or hybrid vehicles.

The base 12 includes a box-shaped body 20 defining a front end 22, a rear end 24, and a pair of side walls 26 and 28. In the illustrated embodiment shown in FIGS. 1 through 5, the front end 22 and the rear end 24 are open such that they do not have solid wall portions formed from folded portions of the blank. It should be understood that the front end 22 and rear end 24 may include wall portions (not shown) if so desired. The body 20 further defines an upper plate 30 spaced from a lower plate 32. The upper and lower plates 30 and 32 extend from the front end 22 to the rear end 24.

The body 20 includes a locking feature, indicated generally at 34, which prevents the removal of the spring clamp 14 after assembly onto the base 12 and prevents movement of the spring clamp 14 relative to the base 12 in a lateral direction normal to the assembly direction 16 and the insertion direction 19, as will be discussed in detail below. The locking feature 34 includes a tab 36 extending outwardly from the upper plate 30 which engages with a portion of the spring clamp 14 at an edge 38 of the tab 36. The tab 36 includes a sloped surface 40 rising in height as moving in the assembly direction 16 along the surface of the upper plate 30. The tab 36 may be created using a cutting and/or lancing operation. For example, a U-shaped cut may be sheared into the upper plate 30. The material within the U-shaped cut is punched outwardly leaving the tab 36 attached to the upper plate 30. During assembly, the tab 36 may be resilient such that it deflects by a relatively small amount when the spring clamp 14 is mounted onto the base 12. Alternatively, the material of the base 12 may have sufficient strength such that the tab 36 is not deflected during the assembly process.

The locking feature 34 may also be defined by notches or other features formed in the base 12 which interact with the spring clamp 14 to prevent the movement of the spring clamp 14 relative to the base 12 in a lateral direction normal to the assembly direction 16 and the insertion direction 19. For example, the upper plate 30 of the base 12 may include pair of spaced apart notches 44 formed therein which receives portions of the spring clamp 14, as will be discussed below. Similarly, the lower plate 32 of the base 12 may include a pair of spaced apart notches 46 formed therein also receiving portions of the spring clamp 14.

Figure 2:
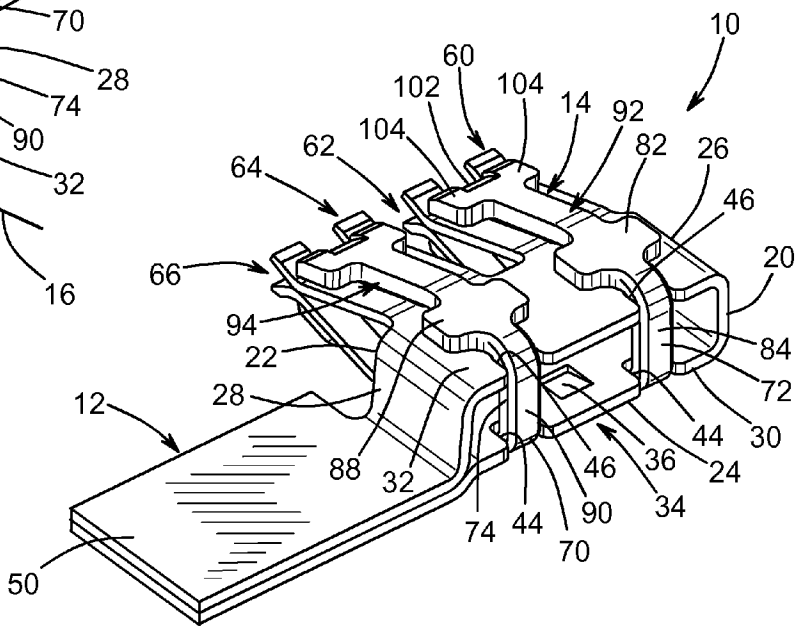
FIG. 2 is a bottom perspective view of the electrical terminal assembly of FIG. 1.
Figure 4:
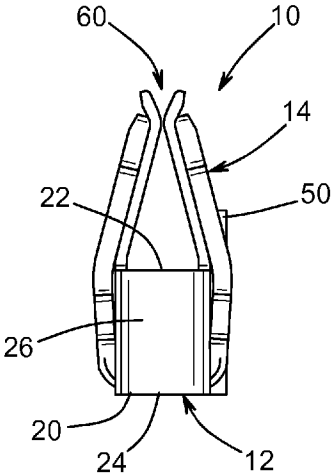
FIG. 4 is an elevational end view of the electrical terminal assembly of FIG. 1.

The base 12 further includes a terminal plate 50 extending outwardly from the side wall 28. The terminal plate 50 is used to connect with an end of a wire conductor (not shown). The end of the wire conductor may be welded, soldered, or otherwise connected to a flat surface 52 of the terminal plate 50 to provide electrical communication between the wire conductor and the base 12. The terminal plate 50 can have any shape or configuration suitable for connecting to the end of the wire connector. As shown in FIGS. 1 and 2, the terminal plate 50 is formed from a pair of relatively thin strip portions of the blank folded against one another. The terminal plate 50 may extend outwardly from the body 20 in any direction.

Extending from the front end 22 of the body 20 are a plurality of elongated fingers or base beams which engage the blade 18 to complete an electrical connection between the base 12 and the blade 18. In the embodiment shown, the base 12 includes four pairs of opposed base beams, indicated generally at 60, 62, 64, and 66, extending outwardly from the front end 22 of the body 20 in the insertion direction. Each pair of base beams 60, 62, 64, and 66 includes a base beam extending from the upper plate 30 and a base beam extending from the lower plate 32. The base beams are resilient such that each base beam from the pair of base beams 60, 62, 64, and 66 will move outwardly from one another to receive the blade 18 when inserted therebetween. The base beams provide electrical contact with the blade 18.

The spring clamp 14 has body 70 defining a first U-shaped clamp base 72 and a second U-shaped clamp base 74. The first and second clamp bases 72 and 74 may be integrally formed together by a bridge 76, as shown in FIGS. 1 through 5, or may be separate from one another. The first clamp base 72 includes an upper pad 80, a lower pad 82, and a U-shaped strut 84 connecting the upper and lower pads 80 and 82 together. Similarly, the second clamp base 74 includes an upper pad 86, and lower pad 88, and a strut 90 connecting the upper and lower pads 86 and 88 together. The upper pads 80 and 86 are positioned against the upper plate 30 of the base 12. The lower pads 82 and 88 are positioned against the lower plate 32 of the base 12. The bridge 76 is attached to the upper pads 80 and 86. The pads 80, 82, 86, and 88 may be wider than the struts 84 and 90 to provide stability of the spring clamp 14 on the base 12. The struts 84 and 90 may be thinner than the pads 80, 82, 86, and 88 to reduce material and weight. During final assembly of the electrical terminal assembly 10, the struts 84 and 90 are disposed within the notches 44 and 46 of the base 12, thereby preventing lateral movement of the spring clamp 14 relative to the base 12.

The spring clamp 14 further includes a pair of opposed spring beams, indicated generally at 92 and 94. The pair of spring beams 92 extends outwardly in the insertion direction 16 from the upper and lower pads 80 and 82 of the first clamp base 72. The pair of spring beams 94 extends outwardly in the insertion direction 16 from the upper and lower pads 86 and 88 of the second clamp base 74. The opposed spring beams are resilient such that each of the spring beams from the pair of spring beams 92 and 94 may move outwardly from one another. The pair of spring beams 92 and 94 bias the opposed base beams of the pairs of the base beams 60, 62, 64, and 66 towards one another, thereby providing a clamping force. Each one of the pair of spring beams 92 and 94 provides a clamping bias force for two pairs of base beams 60, 62, 64, and 66 as shown in FIGS. 1 through 5.

Figure 3:
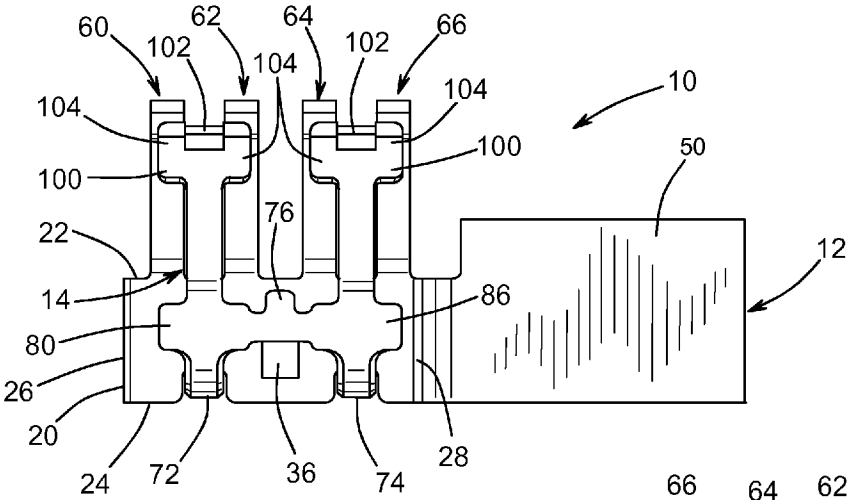
FIG. 3 is a top plan view of the electrical terminal assembly of FIG. 1.
Figure 5:
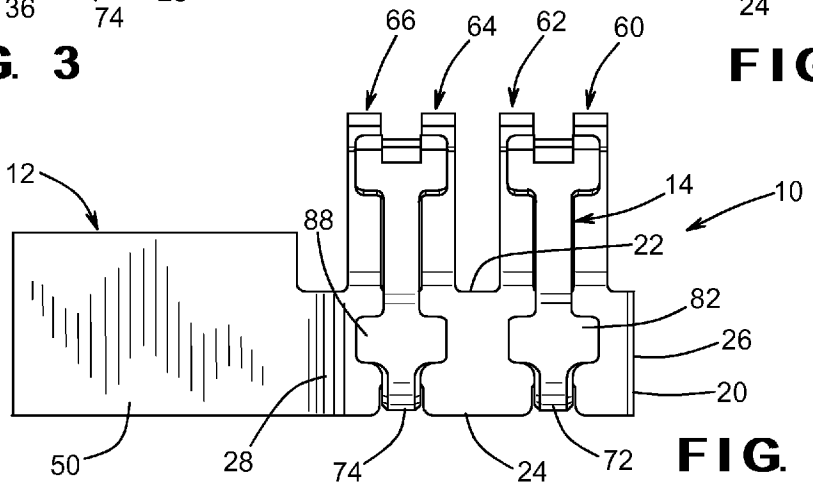
FIG. 5 is a bottom view of the electrical terminal assembly of FIG. 1.

As shown in FIG. 3, each of the spring beams of the pair of spring beams 92 and 94 include end portions 100 having an extension 102 formed between a pair of wing portions 104. Opposed extensions 102 extend inwardly towards one another and are positioned between adjacent base beams of the pairs of base beams 60, 62, 64, and 66. This configuration helps prevent lateral movement of the spring beams relative to the base beams such that the biasing force of the spring means is uniform.

To assemble the electrical terminal assembly 10, the pairs of spring beams 92 and 94 are positioned towards the rear end 24 of the body 20 of the base. The opposed spring beams of the pair of spring beams 92 and 94 are spread open and then the spring clamp 14 is positioned over the rear end 24 of the body 20 and inserted in the assembly direction 16 until the struts 84 and 90 are positioned within the notches 44 and 46. During this back loaded insertion, the bridge 76 slides over the sloped surface 40 of the tab 36 until a sufficient distance such that the edge 38 of the tab 36 engages against bridge 76. The engagement of the bridge 76 against the edge 38 of the tab 36 prevents the spring clamp 14 from moving in the insertion direction 19 opposite the assembly direction 16. It is noted that portions of the body 20 of the base 12 and/or portions of the spring clamp 14 may flex or deflect while the bridge 76 slides over the sloped surface 40 of the tab 36. To prevent movement of the spring clamp 14 relative to the base 12 in the insertion direction 16, the notches 44 and 46 are sized to function as stop members such that the struts 84 and 90 are prevented from further movement once the edge 38 of the tab 36 engages with the bridge 76. As stated above, the positioning of the struts 84 and 90 in the notches 44 and 46 also restricts lateral movement of the spring clamp 14 relative to the base 12.

Due to the back loaded assembly as described above, the base 12 may have a relatively short depth D, as shown in FIG. 1, compared to conventional electrical terminal assemblies such as those disclosed in U.S. Pat. No. 8,366,497, which is hereby incorporated by reference herein. U.S. Pat. No. 8,366,497 discloses a front loaded assembled electrical terminal assembly such that the spring clamp is inserted onto the base in the opposite direction from the assembly direction 16. Although the dimension of the spring clamp 14 may be the same compared to conventional spring clamps, such as those disclosed in U.S. Pat. No. 8,366,497, the depth D of the base 12 may be significantly reduced, thereby providing an electrical terminal assembly 10 requiring less packaging depth.

Figure 6:
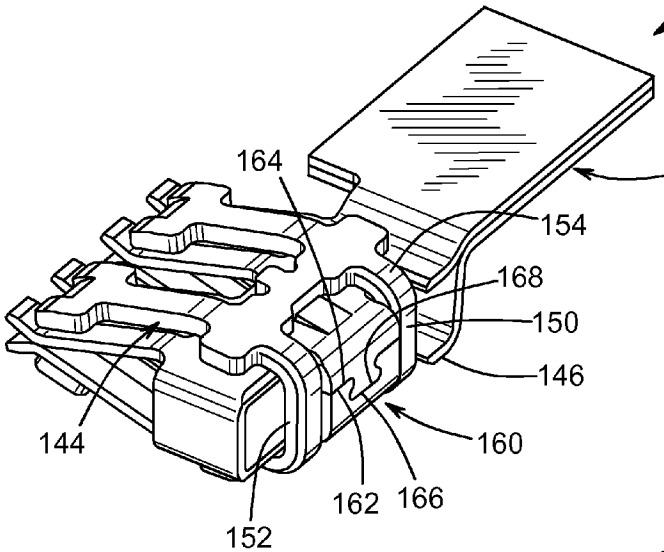
FIG. 6 is a perspective view of a second embodiment of an electrical terminal assembly.

There is illustrated in FIG. 6 a second embodiment of an electrical terminal assembly, indicated generally at 140. The electrical terminal assembly 140 is similar in structure and function as the electrical terminal assembly 10 described above. Thus, only some of the differences will be described below. The electrical terminal assembly 140 includes a base, indicated generally at 142, and a spring clamp, indicated generally at 144. The base 142 includes a rear end 146 having a solid rear wall portion 150 instead of being open such as the rear end 24 of the base 12. When the electrical terminal assembly 140 is assembled, the rear wall portion 150 extends between struts 152 and 154 of the spring clamp 144. The rear wall portion 150 disposed between the struts 152 and 154 helps prevent lateral movement of the spring clamp 144 relative to the base 142.

The rear wall portion 150, as well as all other portions of the base 152, may be formed from a single blank which is stamped and folded to the configuration shown in FIG. 6. The base 152 includes an interlock, indicated generally at 160, which connects edges 162 and 64 of the blank together. The interlock 160 may connect the first and second edges 162 and 164 in a non-over lapping manner. For example, the base 152 may include a dovetail tab 166 extending from the first edge 162 of the blank which interlocks with a correspondingly shaped dovetail recess 168 formed in the second edge 164 of the blank. Of course, the edges 162 and 164 of the blank may also be welded, adhered, or otherwise attached to one another to form the base 152. The use of a dovetail configuration provides a mechanical interlock such that the first edge 162 is prevented from being pulled away from the second edge 164. The dovetail tab 166 has a flared enlarged portion that is connected to the first edge 162 by a reduced necked down portion of the dovetail tab.

Figure 7:
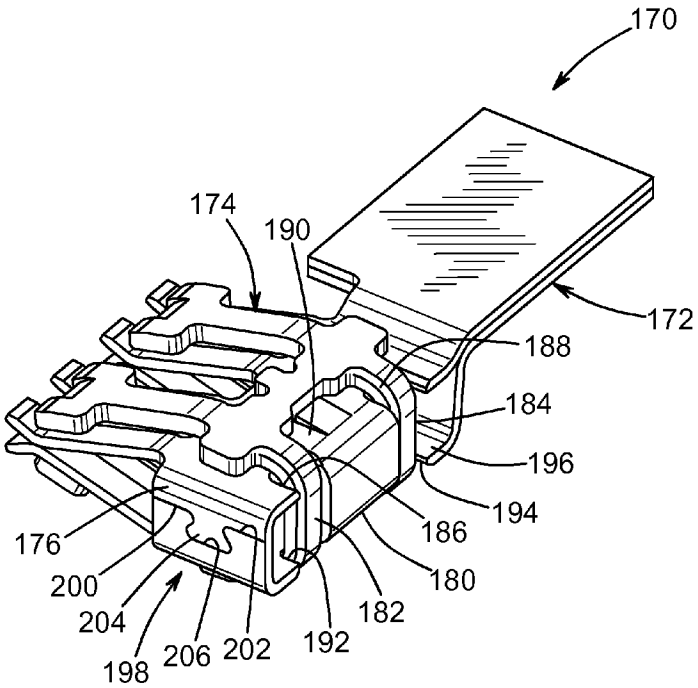
FIG. 7 is a perspective view of a third embodiment of an electrical terminal assembly.

There is illustrated in FIG. 7 a third embodiment of an electrical terminal assembly, indicated generally at 170. The electrical terminal assembly 170 is similar in structure and function as the electrical terminal assemblies 10 and 140 described above. Thus, only some of the differences will be described below. The electrical terminal assembly 170 includes a base, indicated generally at 172, and a spring clamp, indicated generally at 174. The base 172 includes a side wall 176 and a rear wall portion 180. When the electrical terminal assembly 170 is assembled, the rear wall portion 180 extends between struts 182 and 184 of the spring clamp 174. The base 172 includes notches 186 and 188 formed in an upper plate 190. The base 172 also includes notches 192 and 194 formed in a lower plate 196. The strut 152 is disposed in the notches 186 and 192. The strut 154 is disposed in the notches 188 and 194.

The side wall 176, as well as all other portions of the base 172, may be formed from a single blank which is stamped and folded to the configuration shown in FIG. 7. The base 172 includes an interlock, indicated generally at 198, which connects edges 200 and 202 of the blank together. The interlock 198 may connect the first and second edges 200 and 202 in a non-over lapping manner. For example, the base 172 may include a dovetail tab 204 extending from the first edge 200 of the blank which interlocks with a correspondingly shaped dovetail recess 206 formed in the second edge 202 of the blank. Of course, the edges 200 and 202 of the blank may also be welded, adhered, or otherwise attached to one another to form the base 172. The use of a dovetail configuration provides a mechanical interlock such that the first edge 200 is prevented from being pulled away from the second edge 202.

There is illustrated in FIG. 8 a fourth embodiment of an electrical terminal assembly, indicated generally at 220. The electrical terminal assembly 220 is similar in structure and function as the electrical terminal assembly 10 described above. The electrical terminal assembly 220 includes a base 222, as shown in FIG. 10, and a spring clamp 224, shown in FIG. 9. One of the differences is that locking features, indicated generally at 230, are formed on end portions 232 of spring beams 234 of the spring clamp 224. Each of the end portions 232 of the spring beams 234 includes an inwardly extending tab 236. The tabs 236 define sloped surfaces 238 and edges 240. Similar to the tabs 36, the tabs 236 may be created using a cutting and/or lancing operation.

As shown in FIG. 9, the base 222 has two pairs of opposed base beams 250. Each of the pairs of opposed base beams includes a stepped slot 252 formed in the base beams. Each of the slots 252 has a first portion 254 having a width W1, and a second portion 256 have a width W2 which is less than the width W1. The first and second portions 254 and 256 define shoulders 258. When the spring clamp 224 is mounted on the base 222, the edges 240 of the tabs 236 of the spring clamp 224 are positioned adjacent the shoulders 258 of the base beams. This configuration helps prevent the spring clamp 224 from being pulled away from the base 222 and also provides resistance of lateral movement of the spring beams 234 relative to the pairs of base beams 250. Alternatively, the pairs of base beams 250 may be formed without the second portions 256 of the slots 252.

There is illustrated in FIG. 8 a fourth embodiment of an electrical terminal assembly, indicated generally at 220. The electrical terminal assembly 220 is similar in structure and function as the electrical terminal assembly 10 described above. The electrical terminal assembly 220 includes a base 222, as shown in FIG. 10, and a spring clamp 224, as shown in FIG. 9. One of the differences is that locking features, indicated generally at 230, are formed on end portions 232 of spring beams 234 of the spring clamp 224. Each of the end portions 232 of the spring beams 234 includes an inwardly extending tab 236. The tabs 236 define sloped surfaces 238 and edges 240. Similar to the tabs 36, the tabs 236 may be created using a cutting and/or lancing operation.

As shown in FIG. 9, the base 222 has two pairs of opposed base beams 250. Each of the pairs of opposed base beams 250 includes a stepped slot 252 formed in the base beams. Each of the slots 252 has a first portion 254 having a width W1, and a second portion 256 have a width $W_2$ which is less than the width $W_1$. The first and second portions 254 and 256 define shoulders 258. When the spring clamp 224 is mounted on the base 222, the edges 240 of the tabs 236 of the spring clamp 224 are positioned adjacent the shoulders 258 of the base beams, as shown in FIG. 8. This configuration helps prevent the spring clamp 224 from being pulled away from the base 222. Preferably, the width $W_1$ of the first portions 254 of the slots 252 are equal to or slightly greater than the width of the tabs 236 such that the tabs 236 are disposed and snug within the first portions 254 of the slots 252 when the spring clamp 224 is fully assembled onto the base 222 to provides resistance of lateral movement of the spring beams 234 relative to the pairs of base beams 250. Alternatively, the pairs of base beams 250 may be formed without the second portions 256 of the slots 252.

Figure 12:
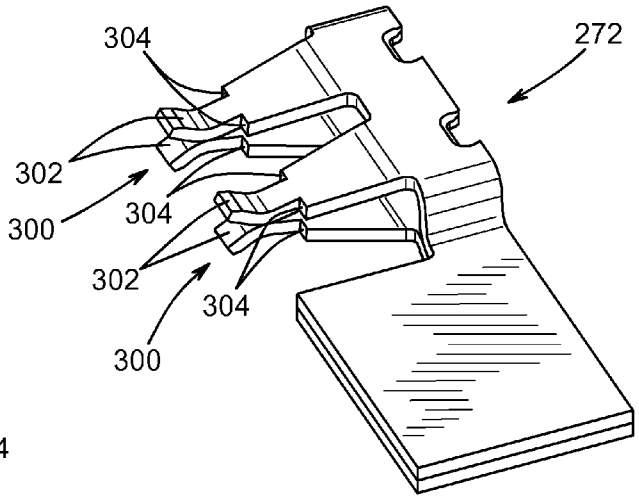
FIG. 12 is a perspective view of a base of the electrical terminal assembly of FIG. 11.
Figure 11:
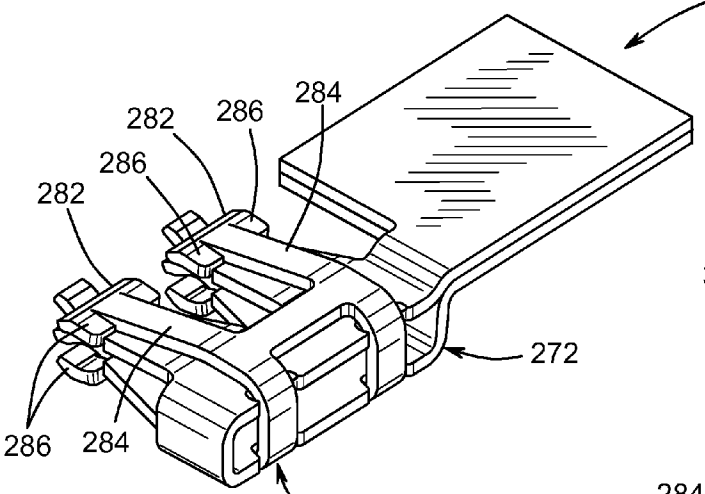
FIG. 11 is a perspective view of a fifth embodiment of an electrical terminal assembly.
Figure 13:
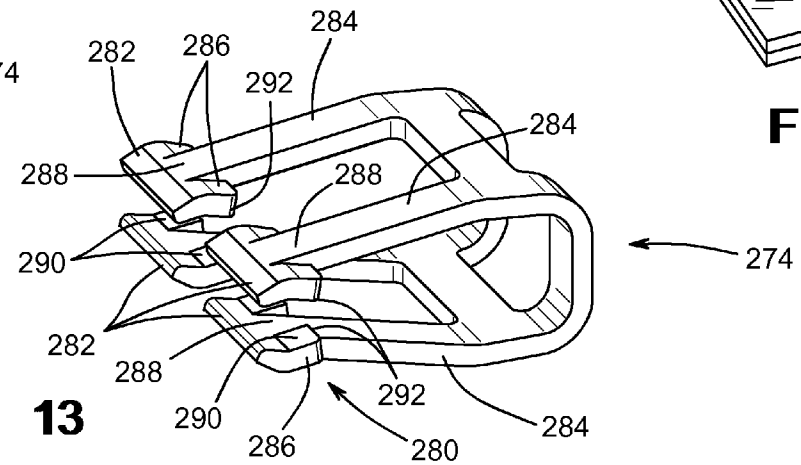
FIG. 13 is a perspective view of a spring clamp of the electrical terminal assembly of FIG. 11.

There is illustrated in FIG. 11 a fifth embodiment of an electrical terminal assembly, indicated generally at 270. The electrical terminal assembly 270 is similar in structure and function as the electrical terminal assembly 10 described above. The electrical terminal assembly 270 includes a base 272, as shown in FIG. 12 and a spring clamp 274, as shown in FIG. 13. One of the differences is that locking features, indicated generally at 280, are formed on end portions 282 of spring beams 284 of the spring clamp 282. Each of the end portions 282 of the spring beams 284 includes a pair of inwardly extending tabs 286 disposed on either side of a central portion 288 of the spring beams 234. Each of the pairs of tabs 286 defines a sloped surface 290 and an edge 292.

As shown in FIG. 12, the base 272 has two pairs of opposed base beams 300. Each of the pairs of opposed base beams 300 includes a narrowed central tip portion 302 defining a pair of shoulders 304 on either side of the central tip portion 302. When the spring clamp 274 is mounted on the base 272, the edges 292 of the tabs 286 of the spring clamp 274 are positioned adjacent the shoulders 304 of the base beams 300, as shown in FIG. 11. This configuration helps prevent the spring clamp 274 from being pulled away from the base 272 and also provides resistance of lateral movement of the spring beams 284 relative to the pairs of base beams 300.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical terminal assembly comprising:

a base including a body having a first end and a second end, wherein first and second opposed base beams extend from the first end of the body in a first direction;

a spring clamp having a clamp base and first and second opposed spring beams extending from the clamp base in the first direction and disposed over the first and second base beams biasing the first and second base beams towards one another, wherein the spring clamp is assembled onto the base by moving the spring clamp along the first direction onto the base; and a locking feature integrally formed in the base and the spring clamp preventing the removal of the spring clamp from the base along a second direction opposite the first direction, and wherein the locking feature prevents movement of the spring clamp relative to the base in a lateral direction normal to the first direction.

2. The assembly of claim 1, wherein the locking feature includes a tab formed in the base which engages with a portion of the clamp base when the spring clamp is fully assembled onto the base.

3. The assembly of claim 2, wherein the tab includes a sloped surface upon which the clamp base slides along when being assembled onto the base when moved in the first direction.

4. The assembly of claim 3, wherein the tab is resiliently formed in the base such that the tab may be deflected during assembly of the spring clamp onto the base.

5. The assembly of claim 3, wherein the tab is formed by a lancing operation.

6. The assembly of claim 1, wherein the locking feature includes a tab formed in the spring clamp which engages with a portion of the base when the spring clamp is fully assembled onto the base.

7. The assembly of claim 6, wherein the tab is formed on an end portion of one of the first and second spring beams.

8. The assembly of claim 7, wherein the tab includes a sloped surface sliding along the base beams when the spring clamp is being assembled onto the base and moved in the first direction.

9. The assembly of claim 7, wherein the tab is formed by a lancing operation.

10. The assembly of claim 7, wherein the first base beam includes a slot extending in the first direction, and wherein the slot defines a shoulder formed in the first base beam which engages with the tab when the spring clamp is assembled onto the base.

11. The assembly of claim 10, wherein the width of the slot is equal to or greater than the width of the tab such that the tab is disposed within the slot when the spring clamp is fully assembled onto the base.

12. The assembly of claim 1, wherein the locking feature includes a pair of spaced apart tabs formed on an end of the first spring beam which engage with spaced apart shoulders formed in the first base beam.

13. The assembly of claim 12, wherein the first base beam includes an end portion extending outwardly from between the shoulders, and wherein the end portion includes an electrical contact for engagement with a blade terminal.

14. The assembly of claim 1, wherein the second end of the body includes a notch formed therein, and wherein a portion of the clamp base extends into the notch of the base preventing movement of the spring clamp relative to the base in a lateral direction normal to the first direction.

15. The assembly of claim 1, wherein the base is made from a folded flat blank and the body of the base includes side walls extending between the first and second ends of the base, and wherein a terminal plate extends from one of the side walls.

16. The assembly of claim 15, wherein one of the side walls is defined by joining a first edge of the flat blank with an opposite second edge of the flat blank together, and wherein a tab is formed in the first edge which interlocks with a recess formed in the second edge to prevent separation of the edges.

17. The assembly of claim 16, wherein a portion of the folded blank forms a rear wall defined by joining a first edge of the flat blank with an opposite second edge of the flat blank together, and wherein a tab is formed in the first edge which interlocks with a recess formed in the second edge to prevent separation of the edges.

18. The assembly of claim 1, wherein the first and second opposed base beams defines a first pair of base beams, and wherein the base further includes a second pair of base beams, and wherein the first and second spring beams defines a first pair of spring beams, and wherein the spring clamp further includes a second pair of spring beams engaged with the second pair of base beams, and wherein the spring clamp includes a cross member connecting the first and second pair of spring beams to one another.

19. An electrical terminal assembly comprising:

a base including a body having a first end and a second end, wherein first and second opposed base beams extend from the first end of the body in a first direction, and wherein the second end of the body includes a notch formed therein; and a spring clamp having a clamp base and first and second opposed spring beams extending from the clamp base in the first direction and disposed over the first and second base beams biasing the first and second base beams towards one another, wherein a portion of the clamp base extends into the notch of the base preventing movement of the spring clamp relative to the base in a lateral direction normal to the first direction.

* * * * *